US011209200B2

(12) United States Patent
Yun

(10) Patent No.: US 11,209,200 B2
(45) Date of Patent: Dec. 28, 2021

(54) REFRIGERATOR AND ICE-MAKING ASSEMBLY

(71) Applicant: LG ELECTRONICS INC., Seoul (KR)

(72) Inventor: Jongho Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 76 days.

(21) Appl. No.: 16/587,308

(22) Filed: Sep. 30, 2019

(65) Prior Publication Data

US 2020/0103155 A1 Apr. 2, 2020

(30) Foreign Application Priority Data

Sep. 28, 2018 (KR) ..... 10-2018-0116088

(51) Int. Cl.
*F25C 1/10* (2006.01)
*F25C 5/182* (2018.01)

(52) U.S. Cl.
CPC ..... *F25C 1/10* (2013.01); *F25C 5/182* (2013.01)

(58) Field of Classification Search
CPC ..... F25C 1/10; F25C 5/182; F25C 5/187
See application file for complete search history.

(56) References Cited

U.S. PATENT DOCUMENTS 4,492,017 A * 1/1985 Latter ..... F16B 21/00 29/434
4,719,762 A * 1/1988 Osabe ..... F25C 5/187 200/61.2
6,938,428 B2 9/2005 Onishi et al.
7,770,404 B2 * 8/2010 An ..... F25C 1/04 62/137
2019/0078824 A1 3/2019 Yun

FOREIGN PATENT DOCUMENTS

KR 10-2001-0051251 6/2001

OTHER PUBLICATIONS

Extended European Search Report dated Feb. 25, 2020 issued in Application 19200131.1.

* cited by examiner

*Primary Examiner* — Elizabeth J Martin
(74) *Attorney, Agent, or Firm* — KED & Associates LLP

(57) ABSTRACT

An ice-making assembly of the present disclosure an ice maker for making ice, an ice bin located below the ice maker, wherein the ice bin stores ice separated from the ice maker therein, and a detecting lever located below the ice maker and including a pivotable detecting body, wherein the detecting lever detects a full ice state of the ice bin.

17 Claims, 17 Drawing Sheets

REFRIGERATOR AND ICE-MAKING ASSEMBLY

CROSS-REFERENCE TO RELATED APPLICATION

This application is based on and claims the benefit of priority to Korean Patent Application No. 10-2018-0116088, filed in Korea on Sep. 28, 2018, in the Korean Intellectual Property Office, the disclosure of which is incorporated herein in its entirety by reference.

BACKGROUND

1. Field

A refrigerator and an ice-making assembly are discloses therein.

2. Background

In general, refrigerators are home appliances for storing foods at a low temperature by low temperature air.

The refrigerator may include a cabinet in which a storage chamber is formed, and a refrigerator door for opening and closing the storage chamber.

The storage chamber may include a refrigerating compartment and a freezing compartment. The refrigerator door may include a refrigerating compartment door for opening and closing the refrigerating compartment and a freezing compartment door for opening and closing the freezing compartment.

Further, the refrigerator may include an ice-making assembly that generates and stores ice using cool air.

The ice-making assembly may include an ice maker that generates the ice and an ice bin for storing the ice separated from the ice maker therein.

The ice maker may be disposed either in the storage chamber or on a refrigerator door. Further, the ice bin may be disposed either in the storage chamber or on a refrigerator door.

For convenience of a user, a dispenser for dispensing the ice stored in the ice bin may be additionally disposed on the refrigerator door.

A refrigerator is disclosed in Korean Patent Application Publication No. 2001-0051251, which is a prior art document.

The refrigerator of the prior document includes an automatic ice-maker, an ice-making dish, an ice storage container for receiving the ice in the ice-making dish, and an ice detecting arm for detecting an amount of the ice in the ice storage container.

The ice-making plate may separate the ice by a twisting motion (rotational motion) and the ice detecting arm may detect the amount of the ice in the ice storage container by an ascending and descending rotation (up and down rotation).

The ice detecting arm may be rotated under a power of a DC motor.

However, according to the prior art document, since a portion of the ice detecting arm descends and enters the ice storage container in a state in which the ice detecting arm is positioned on a side of the DC motor, a space in which the ice detecting arm is rotated is required on the side of the DC motor.

When an assembly tolerance of the ice detecting arm and the DC motor occurs, during the rotation of the ice detecting arm, the ice detecting arm may rub against or collide with a surrounding structure, resulting in a detection failure.

Further, when the ice is separated from the ice-making dish and falls into the ice storage container in a state in which the portion of the ice detecting arm is in the storage container after the ice detecting arm is rotated, the ice may get caught between the ice detecting arm and the ice-making dish.

BRIEF DESCRIPTION OF THE DRAWINGS

Embodiments will be described in detail with reference to the following drawings in which like reference numerals refer to like elements, and wherein.

DETAILED DESCRIPTION

Figure 1:
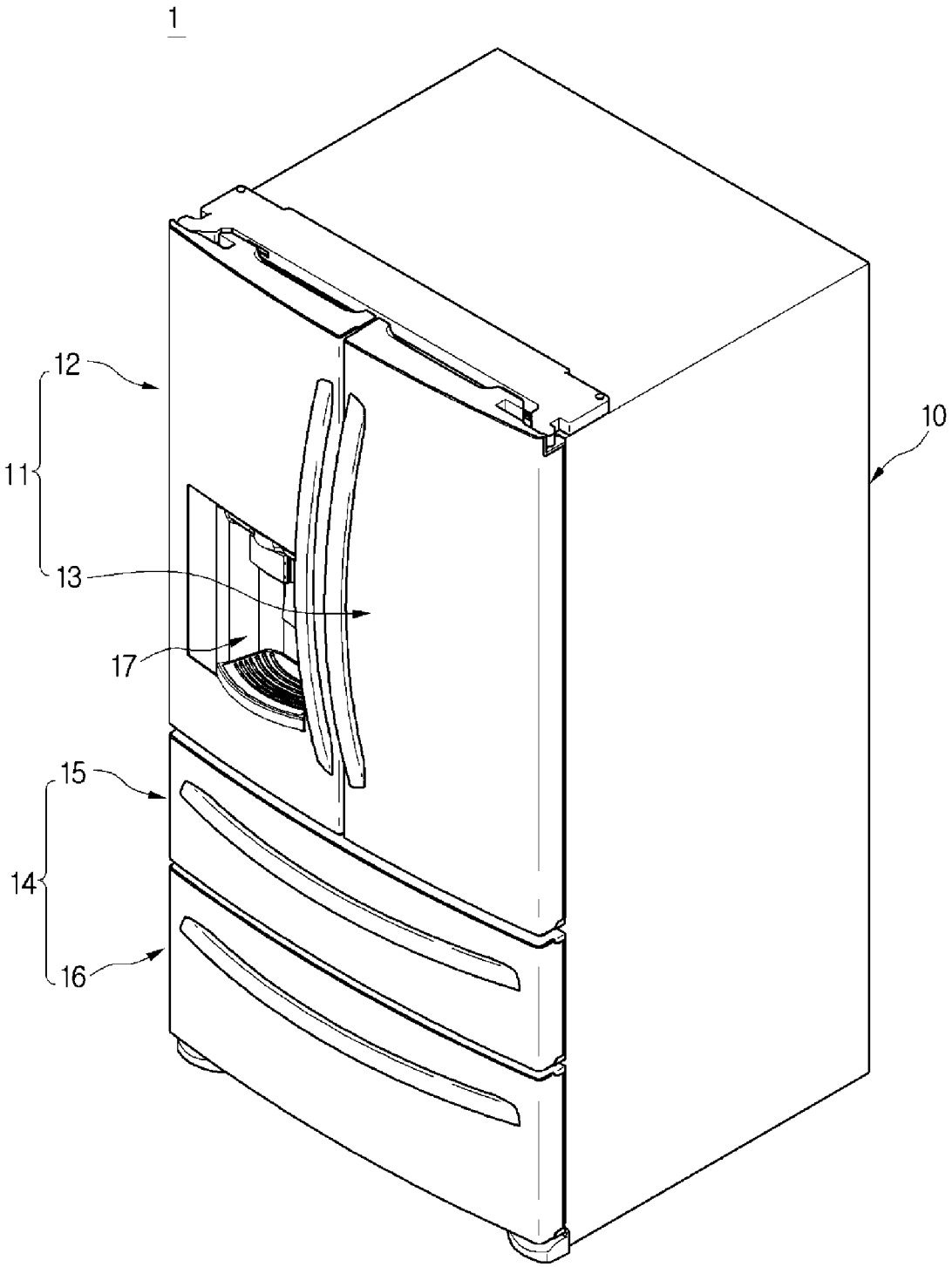
FIG. 1 is a perspective view of a refrigerator according to an embodiment of the present disclosure.

Hereinafter, embodiments will be described with reference to the accompanying drawings. In adding reference numerals to the components of each drawing, it should be noted that the same reference numerals are assigned to the same components as much as possible even though they are illustrated in different drawings. In addition, in describing the embodiments, when it is determined that a detailed description of a related well-known configuration or function interferes with the understanding of the embodiments, the detailed description thereof will be omitted.

In addition, in describing the components of the embodiments, terms such as first, second, A, B, (a), and (b) may be used. These terms are only for distinguishing the components from other components, and the nature, sequence, or order of the components are not limited by the terms. If a component is described as being "connected", "coupled" or "accessed" to another component, that component may be directly connected or accessed to that other component, but It is to be understood that another component may be "connected", "coupled" or "accessed" between each component.

Figure 2:
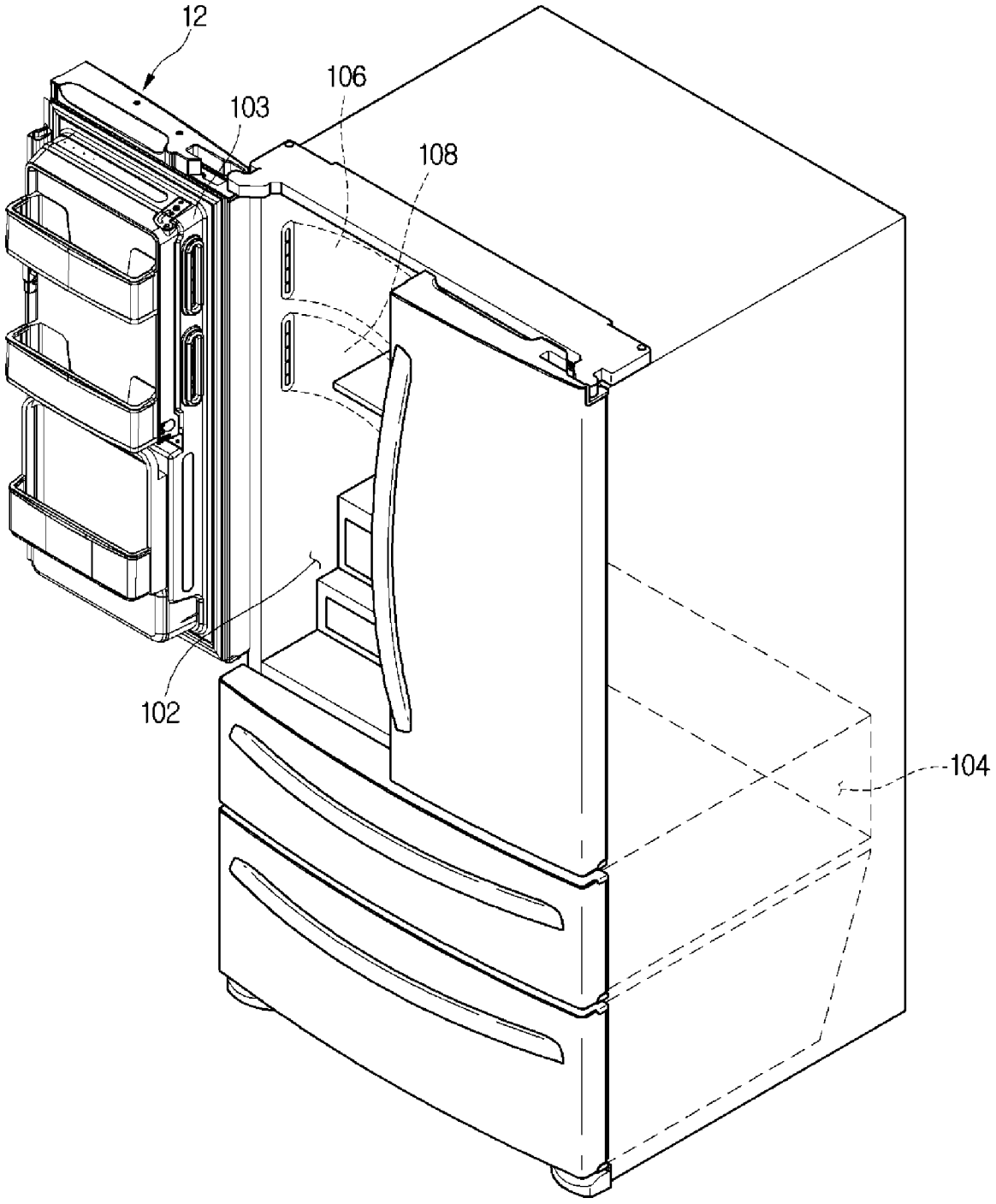
FIG. 2 illustrates a perspective view illustrating a state in which some of refrigerating compartment doors are open according to an embodiment of the present disclosure.

FIG. 1 is a perspective view of a refrigerator according to an embodiment of the present disclosure. FIG. 2 illustrates a perspective view illustrating a state in which some of refrigerating compartment doors are open according to an embodiment of the present disclosure.

Referring to FIGS. 1 and 2, a refrigerator 1 of the present embodiment may include a cabinet 10 forming an outer surface of the refrigerator 1 and refrigerator doors 11 and 14 movably connected to the cabinet 10.

A storage chamber for storing foods therein is formed inside the cabinet 10. The storage chamber may include a refrigerating compartment 102 and a freezing compartment 104 located below the refrigerating compartment 102.

In the present embodiment, as an example, a refrigerator having a bottom freeze type in which a refrigerating compartment is disposed above a freezing compartment will be described. However, the spirit of the present disclosure is not limited thereto, and it should be noted that the spirit of the present disclosure is equally applicable to refrigerators of a type in which the freezing compartment and the refrigerating compartment are arranged in a left and right direction or a type in which the freezing compartment is disposed above the refrigerating compartment.

The refrigerator doors 11 and 14 may include a refrigerating compartment door 11 to open and close the refrigerating compartment 102 and a freezing compartment door 14 to open and close the freezing compartment 104.

The refrigerating compartment door 11 may include a plurality of doors 12 and 13 arranged in the left and right direction. The plurality of doors 12 and 13 may include a first refrigerating compartment door 12 and a second refrigerating compartment door 13 disposed on a right side of the first refrigerating compartment door 12.

The first refrigerating compartment door 12 and the second refrigerating compartment door 13 are movable independently.

The freezing compartment door 14 may include a plurality of doors 15 and 16 arranged in a up and down direction. The plurality of doors 15 and 16 may include a first freezing compartment door 15 and a second freezing compartment door 16 located below the first freezing compartment door 15.

The first and second refrigerating compartment doors 12 and 13 may be pivoted, and the first and second freezing compartment doors 15 and 16 may be slided.

Alternatively, the freezing compartment door 14 may include one door to open or close the freezing compartment 104. Alternatively, each of the first and second freezing compartment doors 15 and 16 may be pivoted.

In one example, a dispenser 17 for dispensing water or ice may be disposed on one of the first and second refrigerating compartment doors 12 and 13.

In FIG. 1, in one example, the dispenser 17 is disposed on the first refrigerating compartment door 12. An ice-making assembly for generating and storing ice (to be described below) may be disposed on one of the first and second refrigerating compartment doors.

In the present embodiment, the dispenser 17 and the ice-making assembly may be disposed on the first refrigerating compartment door 12 or the second refrigerating compartment door 13.

Accordingly, hereinafter, in one example, the dispenser 17 and the ice-making assembly will be described as being disposed on the refrigerating compartment door 11, which collectively refers to the first refrigerating compartment door 12 and the second refrigerating compartment door 13.

Figure 3:
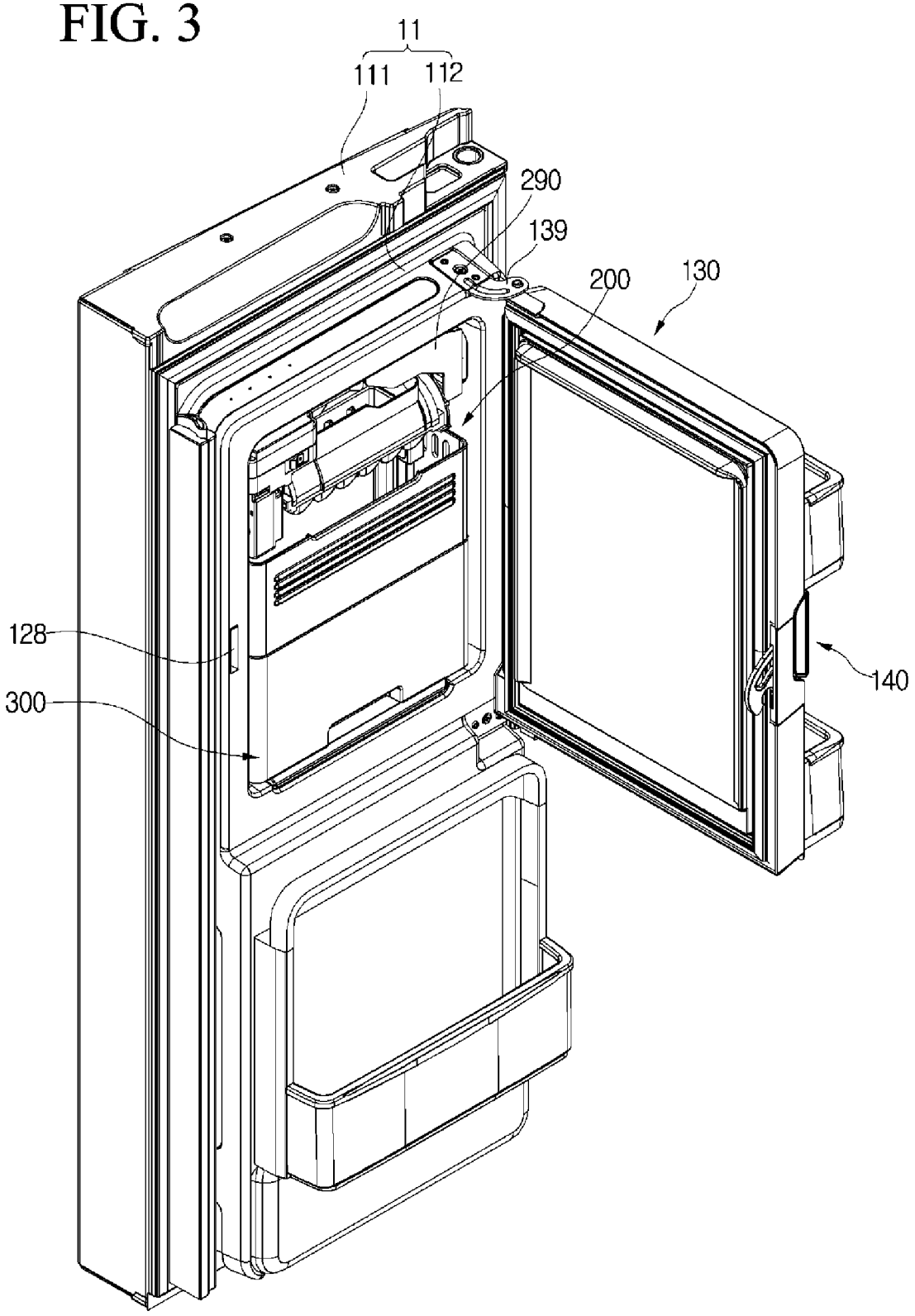
FIG. 3 is a perspective view of a refrigerating compartment door in a state in which an ice compartment door is open according to an embodiment of the present disclosure.
Figure 4:
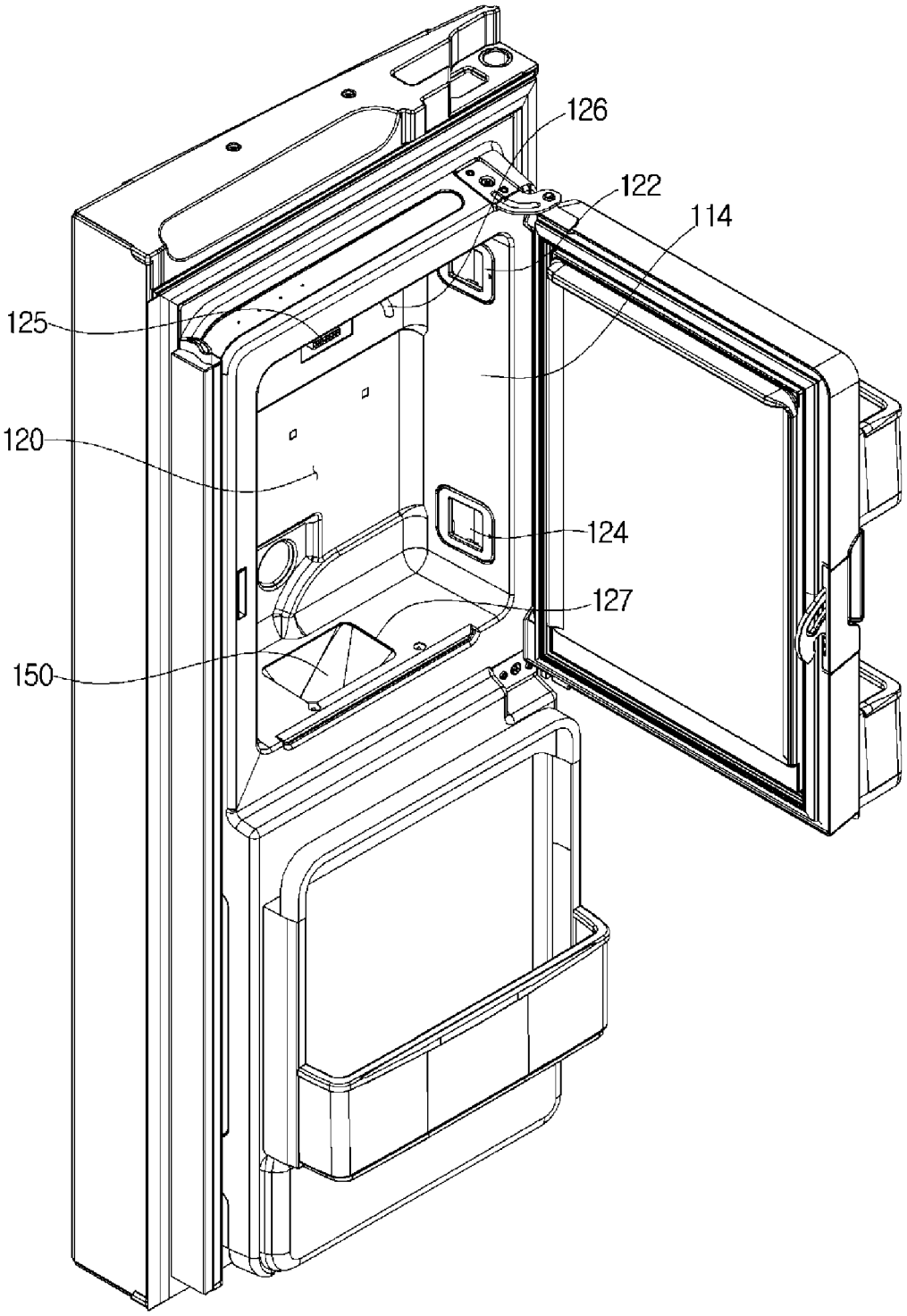
FIG. 4 is a perspective view of a refrigerating compartment door in a state in which an ice-making assembly is removed from an ice compartment according to an embodiment of the present disclosure.

FIG. 3 is a perspective view of a refrigerating compartment door in a state in which an ice compartment door is open according to an embodiment of the present disclosure. Further, FIG. 4 is a perspective view of a refrigerating compartment door in a state in which an ice-making assembly is removed from an ice compartment according to an embodiment of the present disclosure.

Referring to FIGS. 1 to 4, the refrigerating compartment door 11 may include an outer case 111 and a door liner 112 coupled to the outer case 111.

The door liner 112 may form a rear face of the refrigerating compartment door 11.

Further, the door liner 112 may form an ice compartment 120.

An ice-making assembly 200 may be placed in the ice compartment 120 to generate and store ice. The ice compartment 120 may be opened and closed by an ice compartment door 130.

The ice compartment door 130 may be pivotably connected to the door liner 112 by a hinge 139. On the ice compartment door 130, a handle 140 for coupling the ice compartment door 130 to the door liner 112 while the ice compartment 120 is closed may be disposed.

The door liner 112 has a handle coupling portion 128 to which a portion of the handle 140 is coupled. The handle coupling portion 128 accommodates a portion of the handle 140.

The cabinet 10 may include a body supply duct 106 for supplying cool air to the ice compartment 120 and a body collecting duct 108 for collecting cool air from the ice compartment 120.

The body supply duct 106 and the body collecting duct 108 may be in communication with a space in which an evaporator, not shown, is located.

The refrigerating compartment door 11 may further include a door supply duct 122 for supplying cool air from the body supply duct 106 to the ice compartment and a door collecting duct 124 for collecting cool air from the ice compartment 120 to the body collecting duct 108.

The door supply duct 122 and the door collecting duct 124 may extend from an outer wall 113 of the door liner 112 to an inner wall 114 forming the ice compartment 120.

The door supply duct 122 and the door collecting duct 124 may be arranged in a vertical direction, and the door supply duct 122 may be disposed above the door collecting duct 124. However, in the present embodiment, it is noted that there are no restrictions on positions of the door supply duct 122 and the door collecting duct 124.

In a state in which the refrigerating compartment door 11 closes the refrigerating compartment 102, the door supply duct 122 may be in line with and in communication with the body supply duct 106 and the door collecting duct 124 may be in line with and in communication with the body collecting duct 108.

A cool air duct 290 that directs cool air flowed through the door supply duct 122 to the ice-making assembly 200 may be disposed in the ice compartment 120. The cool air duct 290 has a flow path defined therein through which cool air flows, and cool air flowed through the cool air duct 290 is finally supplied to the ice-making assembly 200.

Since cool air may be concentrated toward the ice-making assembly 200 by the cool air duct 290, the ice may be created quickly.

In one example, a first connector 125 for powering the ice-making assembly 200 is disposed on the refrigerating compartment door 11. The first connector 125 is exposed to the ice compartment 120. Further, a water supply pipe 126 for supplying water to the ice-making assembly 200 is disposed on the refrigerating compartment door 11.

The water supply pipe 126 is placed between the outer case 111 and the door liner 112 and one end thereof is passed through the door liner 112 and located in the ice compartment 120.

An opening 127 through which the ice is discharged is defined in a bottom of the lower inner wall 114 of the door liner 112 that forms the ice compartment 120. An ice duct 150 in communication with the opening 127 is disposed below the ice compartment 120.

Figure 5:
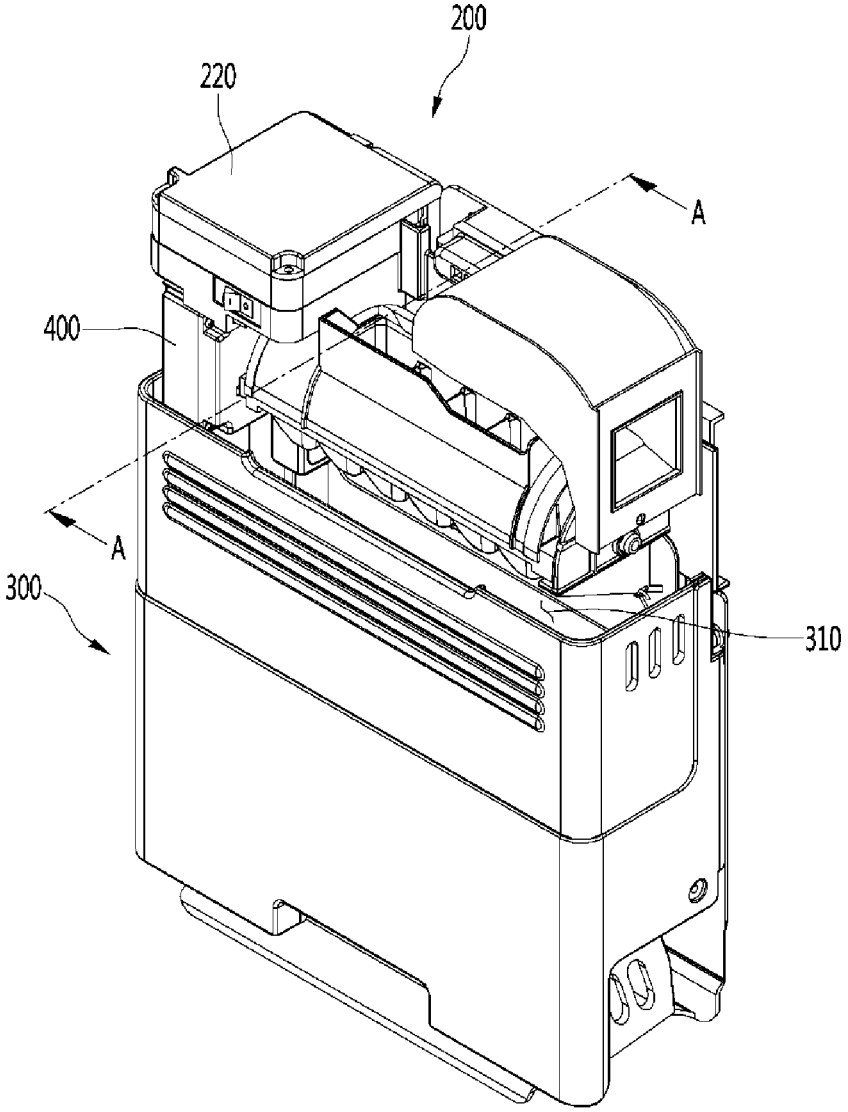
FIG. 5 is a perspective view of an ice-making assembly according to an embodiment of the present disclosure.
Figure 6:
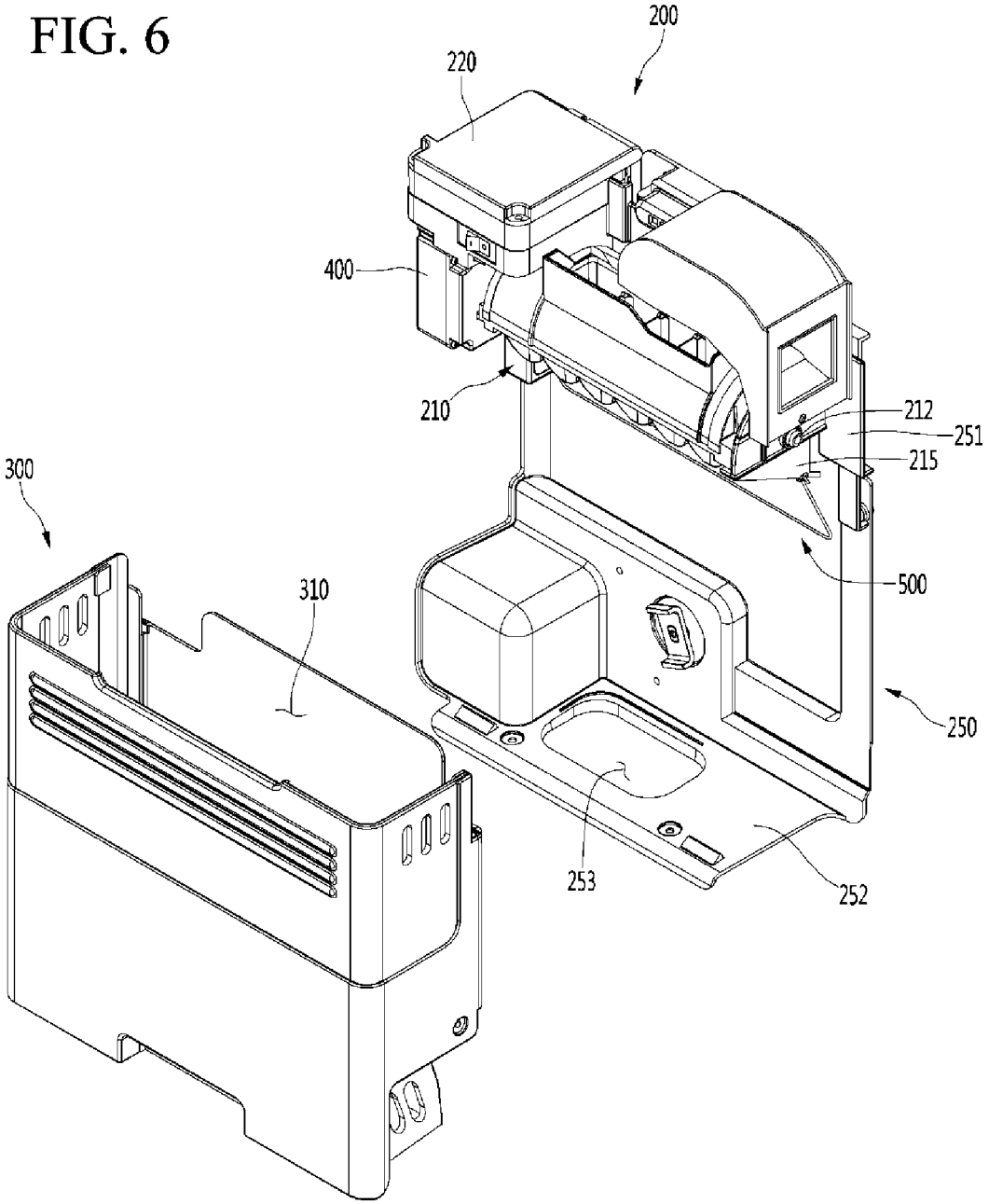
FIG. 6 is a perspective view for illustrating a state in which an ice bin is removed from a support.

FIG. 5 is a perspective view of an ice-making assembly according to an embodiment of the present disclosure. FIG. 6 is a perspective view for illustrating a state in which an ice bin is removed from a support. Further, FIG. 7 is a perspective view taken along a line A-A of FIG. 5.

Figure 7:
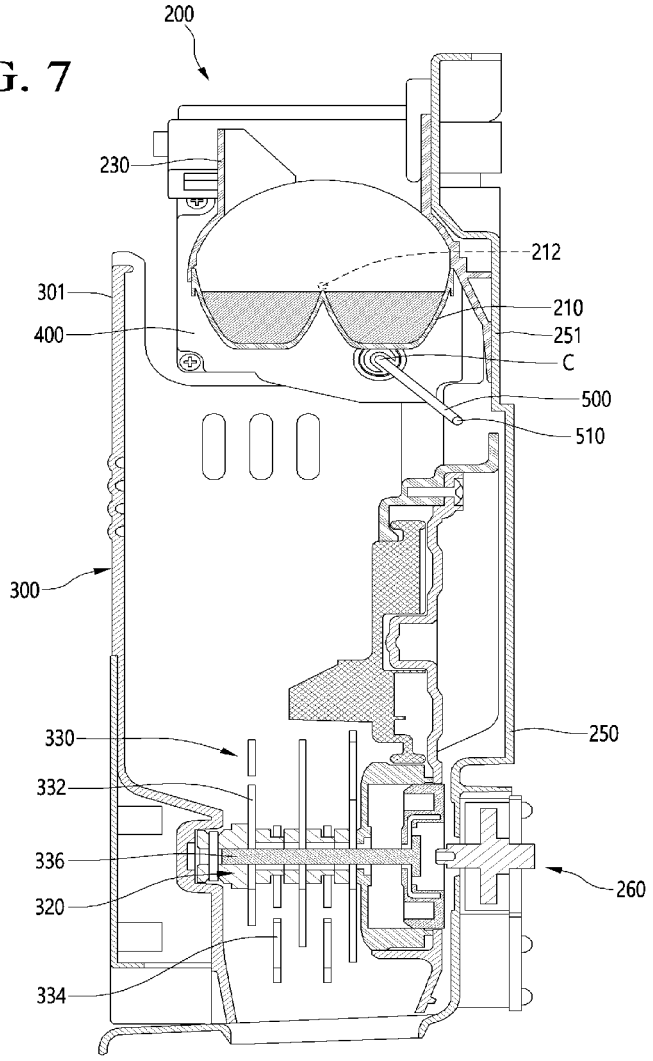
FIG. 7 is a perspective view taken along a line A-A of FIG. 5.

Referring to FIGS. 5 to 7, the ice-making assembly 200 of the present embodiment may include an ice maker 210 for defining therein a space in which the ice is generated and supporting the generated ice and an ice bin 300 for storing the ice generated from the ice maker 210 therein.

Further, the ice-making assembly 200 may further include a driver 400 that provides power to automatically rotate the ice maker 210 for separating the ice from the ice maker 210.

The controller 220 may be disposed on the driver 400. However, in the present embodiment, it should be noted that there is no restriction on a disposition of the controller 200.

Further, the ice-making assembly 200 may further include a support 250 for supporting the ice bin 300 and a support bracket 215 installed on the support 250 to rotatably support the ice maker 210.

A rotation shaft 212 is disposed in a longitudinal direction of the ice maker 210. One side of the rotation shaft 212 may be rotatably connected to the support bracket 215 and the other side of the rotation shaft 2 may be rotatably connected to the gearbox 400.

A cover 230 for covering the ice maker 210 to prevent water overflow when the water is supplied to the ice maker 210 may be disposed on the ice maker 210.

The support 250 may be formed of one body or by a combination of at least two bodies.

The ice bin 300 is seated on one side of the support 250. Further, a motor assembly 260 for rotating an ice discharger 330 disposed in the ice bin 300 is seated on the other side of the support 250.

The support 250 may include a bottom wall 252 on which the ice bin 300 is seated. The bottom wall 252 may have an opening 253 defined therein through which the ice discharged from the ice bin 300 passes.

The ice discharger 330 in the ice bin 300 may include a rotation shaft 336 which may be rotated by the motor assembly 260, a rotating blade 332 coupled to be penetrated by the rotation shaft 336, and a fixed blade 334 coupled to be penetrated by the rotation shaft 336 and fixed to the ice bin 300.

The ice separated from the ice maker 210 may fall to an upper portion of the ice discharger 330 through an ice inlet 310 of the ice bin 300. Depending on a direction of rotation of the rotating blade 336, the ice stored in the ice bin 300 may be discharged from the ice bin 300 in a form of ice chunk or of cube ice.

The ice-making assembly 200 may further include a full ice state detecting lever 500 (hereinafter referred to as a "detecting lever") for detecting a full ice state of the ice bin 300.

One side of the detecting lever 500 may be connected to the driver 400 and the other side thereof may be pivotably connected to the support bracket 215.

The detecting lever 500 connected to the driver 400 may be pivoted by the driver 400 to detect the full ice state of the ice bin 300.

The other side of the detecting lever 500 may be pivotably connected to the support bracket 215 below the rotation shaft 212 of the ice maker 210.

Thus, as shown in FIG. 7, a pivot center C of the detecting lever 500 may be positioned lower than the rotation shaft 212 (a center of rotation) of the ice maker 210.

A direction of extension of the pivot center C of the detecting lever 500 may be parallel to a direction of extension of the center of rotation of the ice maker 210.

In the present embodiment, a position of the detecting lever 500 in FIG. 7 may be referred to as a "standby position (or first position)", and a position of the ice maker 210 may be referred to as an "ice-making position".

The detecting lever 500 may be pivoted from the standby position to a full ice state detection position (or second position) (see FIG. 17) for full ice state detection.

In a state in which the detecting lever 500 is in the standby position, at least a portion of the detecting lever 500 may be positioned below the ice maker 210.

An entirety of the detecting lever 500 may be positioned below the ice maker 210 to prevent interference between the ice maker 210 and the detecting lever 500 during rotation of the ice maker 210.

The support 250 may include a vertical wall 251 extending in the vertical direction. At least a portion of the ice maker 210 may be located between the vertical wall 251 and the front face wall 301 of the ice bin 300.

A horizontal distance between the pivot center C of the detecting lever 500 and the vertical wall 251 may be smaller than a horizontal distance between the rotation shaft 212 of the ice maker 210 and the vertical wall 251.

The detecting lever 500 may include a detecting body 510. The detecting body 510 may be positioned at a lowermost side during the pivoting operation of the detecting lever 500.

Further, the detecting body 510 may be in contact with the ice in the ice bin 300 in the full ice state of the ice bin 300.

The horizontal distance between the detecting body 510 and the vertical wall 251 may be smaller than a shortest horizontal distance between the ice maker 210 and the vertical wall 251 in order to prevent the ice from coming into contact with the detecting body 510 in a state in which the ice is separated from the ice maker 210.

That is, in a state in which the detecting lever 500 is positioned in the standby position, the detecting body 510 may be disposed to be not overlap with the ice maker 210.

Figure 8:
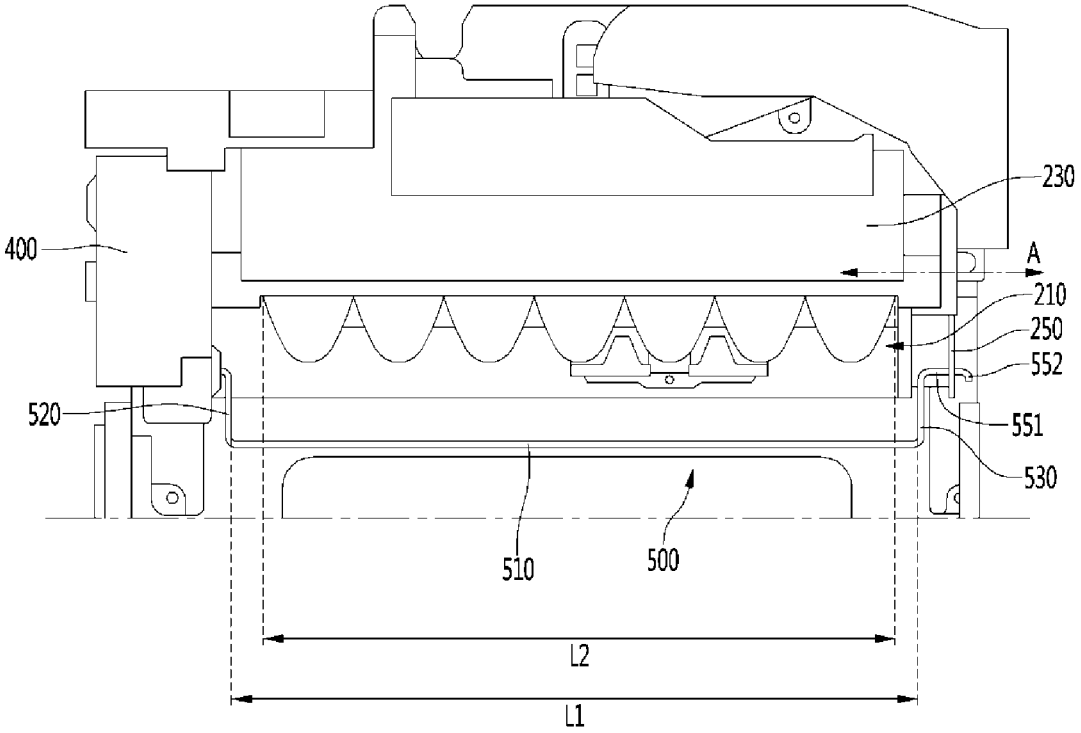
FIG. 8 illustrates arrangement of a detecting lever installed on a support bracket and an ice maker.
Figure 9:
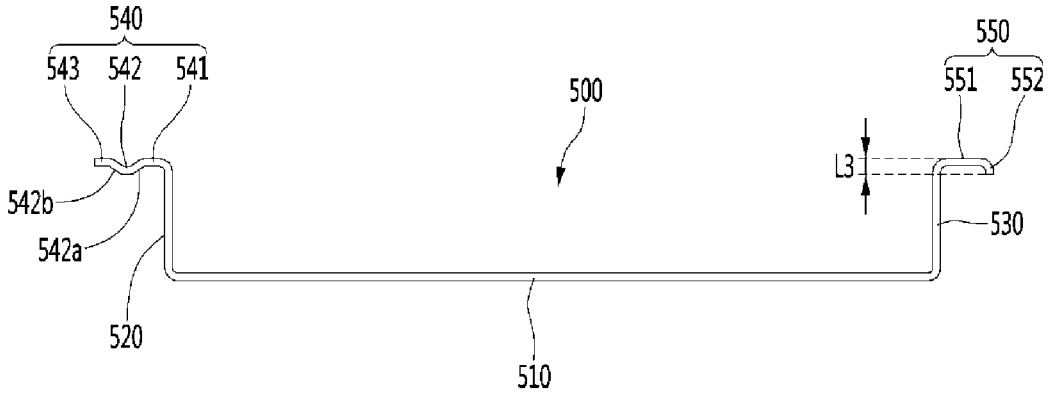
FIG. 9 illustrates a detecting lever according to an embodiment of the present disclosure.
Figure 10:
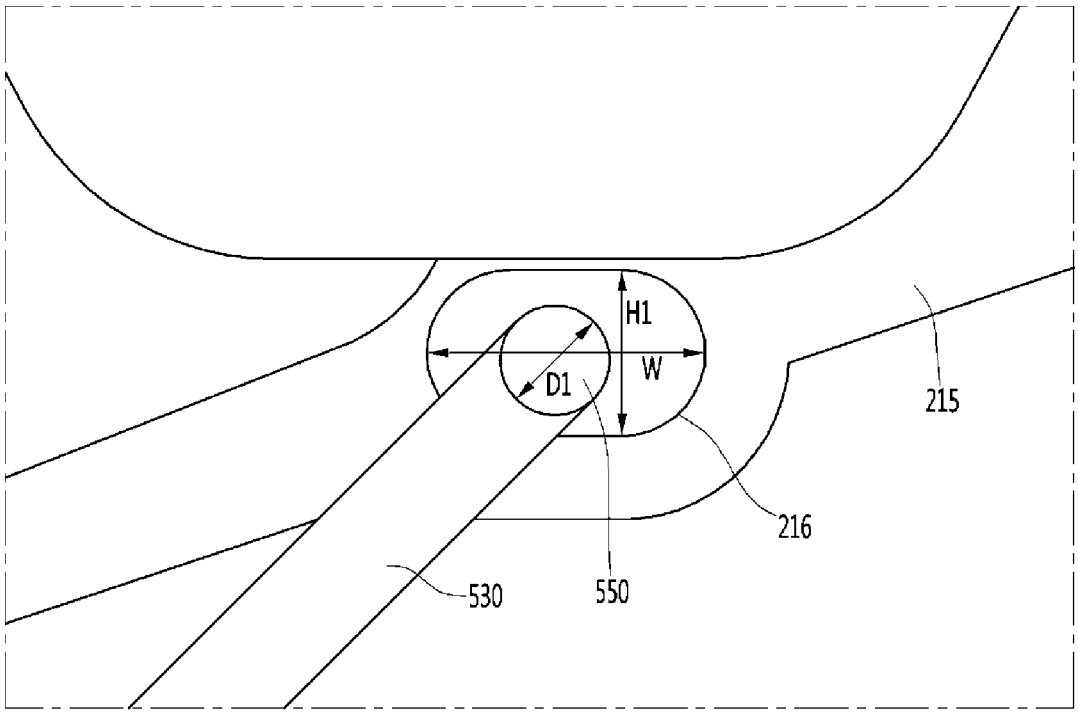
FIG. 10 illustrates a state in which a second coupling portion of a detecting lever is coupled to a support bracket.

FIG. 8 illustrates arrangement of a detecting lever installed on a support bracket and an ice maker. Further, FIG. 9 illustrates a detecting lever according to an embodiment of the present disclosure. Further, FIG. 10 illustrates a state in which a second coupling portion of a detecting lever is coupled to a support bracket.

Referring to FIGS. 7 to 9, the detecting lever 500 may be a wire-shaped lever. That is, the detecting lever 500 may be formed by bending a wire having a predetermined diameter a plurality of times.

The detecting lever 500 may include a detecting body 510. The detecting body 510 may extend in a direction parallel to a direction of extension (see an arrow A) of the rotation shaft 212 of the ice maker 210.

The detecting body 510 may be located lower than a lowermost point of the ice maker 210 regardless of a position of the detecting body 510.

The detecting lever 500 may further include a pair of extension portions 520 and 530 respectively extending from both ends of the detecting body 510. The pair of extension portions 520 and 530 may extend in a direction intersecting the direction of extension of the detecting body 510.

The pair of extension portions 520 and 530 may extend substantially parallel to each other.

The pair of extension portions 520 and 530 may include a first extension portion 520 and a second extension portion 530.

The detecting body 510 and the pair of extension portions 520 and 530 may be formed in a shape, for example, "U".

A horizontal length L1 of the detecting body 510 may be larger than vertical length of each of the pair of extension portions 520 and 530.

The horizontal length L1 of the detecting body 510 may be formed larger than a horizontal length L2 of a portion of the ice maker 210 except for the rotation shaft 212.

That is, a spacing between the pair of extension portions 520 and 530 may be greater than the horizontal length L2 of the portion of the ice maker 210 except for the rotation shaft 212.

Thus, during the pivoting of the detecting lever 500 or the rotation of the ice maker 210, interference between the pair of extension portions 520 and 530 and the ice maker 210 may be prevented.

The detecting lever 500 may further include a pair of coupling portions 540 and 550 that are respectively bent and extended from ends of the pair of extension portions 520 and 530.

The pair of coupling portions 540 and 550 may include a first coupling portion 540 extending from the first extension portion 520 and a second coupling portion 550 extending from the second extension portion 530.

The first coupling portion 540 and the second coupling portion 550 may extend in a direction away from each other respectively from the extension portions 520 and 530.

The first coupling portion 540 may be connected to the driver 400 and the second coupling portion 550 may be connected to the support bracket 215.

At least a portion of the first coupling portion 540 may extend in the horizontal direction. That is, at least a portion of the first coupling portion 540 may be parallel to the detecting body 510.

The first coupling portion 540 and the second coupling portion 550 provide the pivot center C of the detecting lever 500.

In the present embodiment, the second coupling portion 550 may be coupled to the support bracket 215 in an idle state. Thus, the first coupling portion 540 may substantially provide a pivot center C2 of the detecting lever 500.

The first coupling portion 540 may include a first horizontal extension portion 541 extending in the horizontal direction from the first extension portion 520.

Further, the first coupling portion 540 may further include a bent portion 542 bent from the first horizontal extension portion 541.

Although not limited, the bent portion 542 may be formed to be inclined downward in a direction away from the first horizontal extension portion 541 and then inclined upward again.

For example, the bent portion 542 may include a first inclined portion 542*a* that is inclined downward from the first horizontal extension portion 541 and a second inclined portion 542*b* that is inclined upward from the first inclined portion 542*a*.

A boundary portion of the first inclined portion 542*a* and the second inclined portion 542*b* may be located at a lowermost side in the first coupling portion 540.

A reason why the first coupled portion 540 includes the bent portion 542 is to increase a coupling force with the driver 400. A coupling structure of the first coupled portion 540 and the driver 400 will be described below with reference to the drawings.

The first coupled portion 540 may further include a second horizontal extension portion 543 extending in the horizontal direction from an end of the bent portion 542.

As an example, the second horizontal extension portion 543 may extend in the horizontal direction from the second inclined portion 542*b*.

The second horizontal extension portion 543 and the first horizontal extension portion 541 may be located at the same vertical level relative to the detecting body 510. That is, the first horizontal extension portion 541 and the second horizontal extension portion 543 may be located on the same extension line.

In another example, in the present embodiment, the first coupling portion 540 may include only the first horizontal extension portion 541 or include only the first horizontal extension portion 541 and bent portion 542.

Alternatively, the first coupling portion 540 may include only the bent portion 542 and the second horizontal extension portion 543.

The second coupling portion 550 may include a coupling body 551 extending in the horizontal direction from the second extension portion 530 and a hooking body 552 bent from the coupling body 522.

The coupling body 551 may extend in parallel with the detecting body 510 as an example.

The hooking body 552 may extend in the vertical direction as an example. The hooking body 552 may extend downward from the coupling body 551.

The hooking body 552 may extend in parallel with the second extension portion 530.

The second coupling portion 550 may penetrate the support bracket 215. A hole 216 through which the second coupling portion 550 passes may be defined in the support bracket 215.

The hole 216 may be a long hole in which a horizontal width W thereof is larger than a height H1 thereof.

In the first coupling portion 550, the coupling body 551 may penetrate the hole 216 after the hooking body 552 penetrates the hole 216.

Thus, referring to FIG. 8, in a state in which the first coupling portion 540 is coupled with the driver 400 and the second coupling portion 550 penetrated the support bracket 215, the support bracket 215 may be located between the second extension portion 530 and the hooking body 552.

In this state, the second extension portion 530 and the hooking body 552 may be spaced apart from the support bracket 215.

Thus, contact of the second extension portion 530 and the hooking body 552 with the support bracket 215 during the pivoting of the detecting lever 500 may be minimized.

A cross section of the coupling body 551 may be circular. The coupling body 551 may have a first diameter D1.

The first diameter D1 of the coupling body 551 may be smaller than the width W and the height H1 of the hole 216.

As in the present embodiment, as the cross section of the coupling body 551 is formed in the circular shape (since the coupling body 551 has no edge shape), even when the ice is produced on a circumference of the coupling body 551, the ice on the circumference of the coupling body 551 may be easily removed during the pivoting of the detecting lever 500.

Further, as the first diameter D1 of the coupling body 551 is smaller than the width W and height H1 of the hole 216, even when the ice is produced on the circumference of the coupling body 551, it may be limited that generation of the ice in an entirety of the hole 216.

Thus, the coupling body 551 may move within the hole 216, thereby enabling the pivoting of the detecting lever 500.

Further, when the coupling body 551 moves within the hole 216, the ice produced on the circumference of the coupling body 551 may be removed from the coupling body 551 by a portion defining the hole 216 in the support bracket 215.

In order to prevent the second coupling portion 550 from easily being separated from the hole 216 during the pivoting of the detecting lever 500, a vertical length L3 of the second coupling portion 550 (a sum of the first diameter of the coupling body 551 and the length of the hooking body 552) may be greater than the height H1 of the hole 216.

The vertical length L3 of the second coupling portion 550 may be smaller than the width W of the hole 216 such that the second coupling portion 550 may be coupled to the hole 216.

Figure 11:
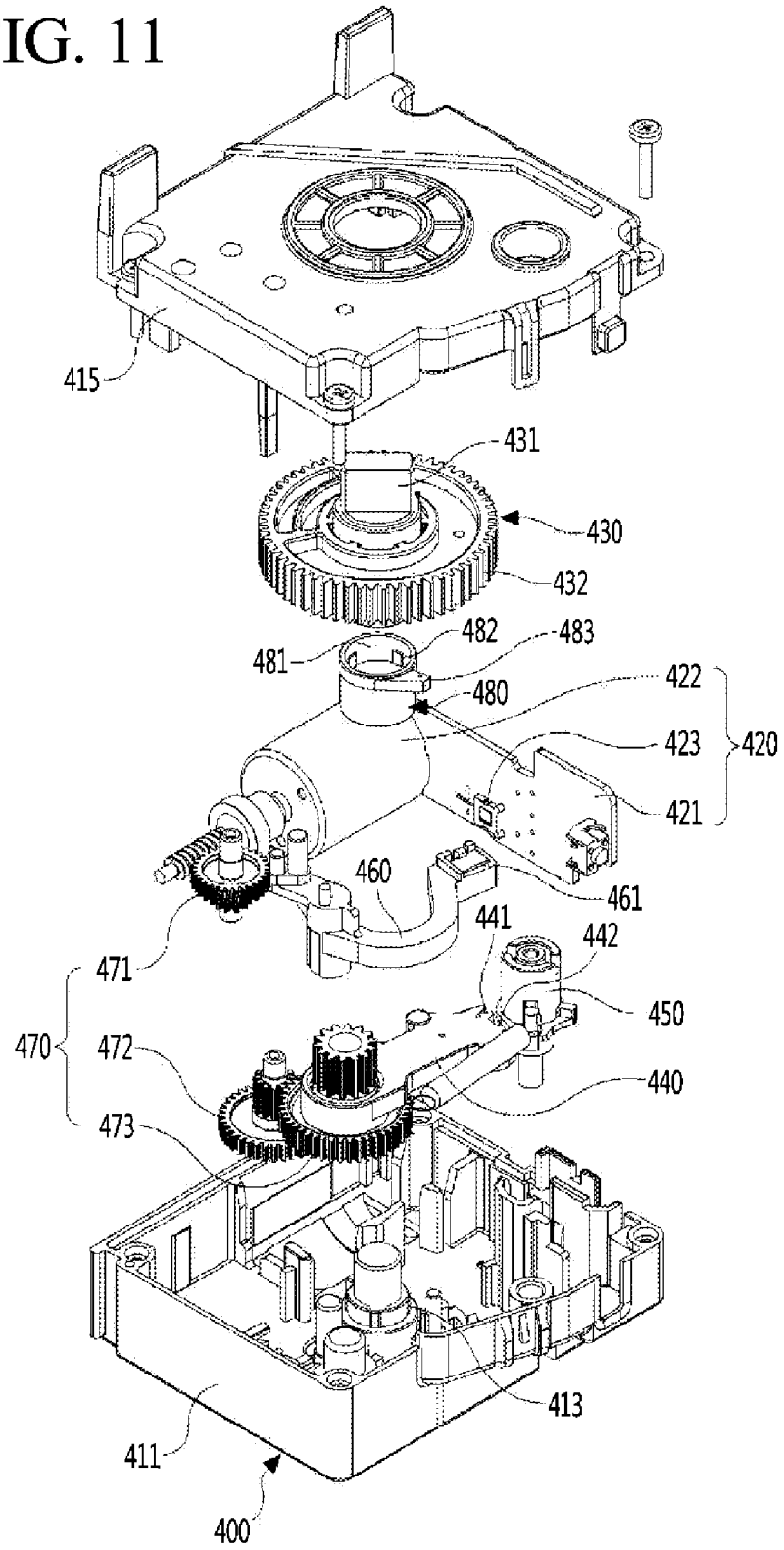
FIG. 11 is an exploded perspective view of a driver according to an embodiment of the present disclosure.
Figure 12:
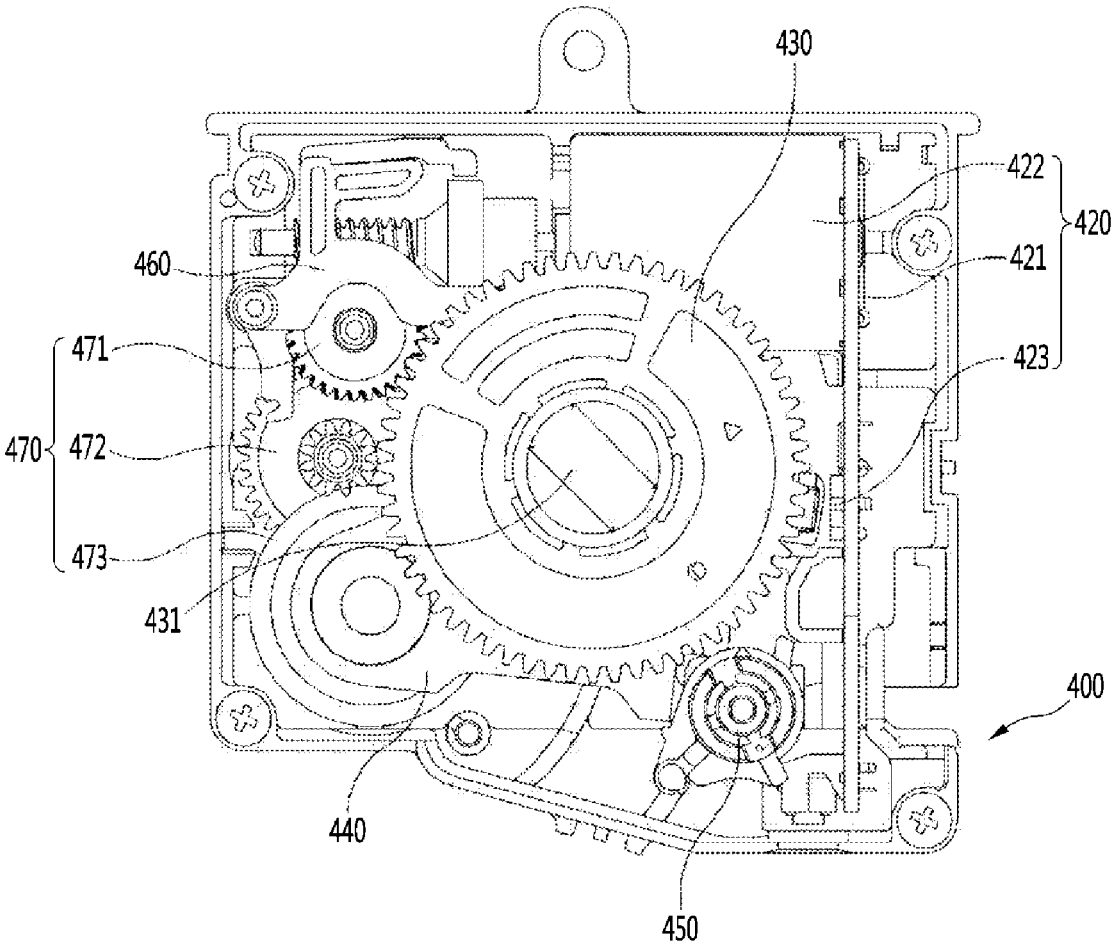
FIG. 12 is a plan view illustrating an internal configuration of a driver according to an embodiment of the present disclosure.

FIG. 11 is an exploded perspective view of a driver according to an embodiment of the present disclosure. Further, FIG. 12 is a plan view illustrating an internal configuration of a driver according to an embodiment of the present disclosure.

Figure 13:
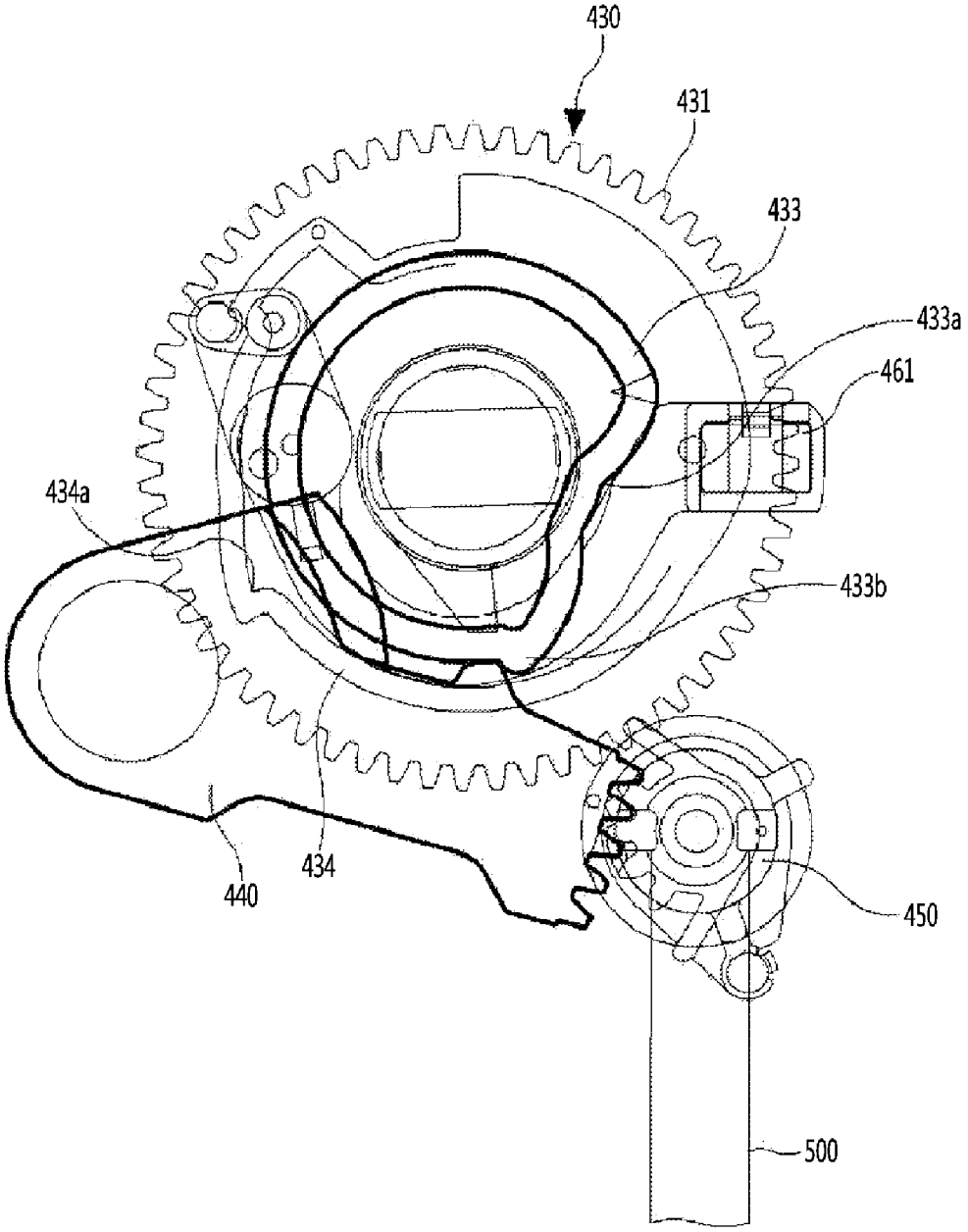
FIG. 13 illustrates a cam gear and an operating lever of a driver according to an embodiment of the present disclosure.

FIG. 13 illustrates a cam gear and an operating lever of a driver according to an embodiment of the present disclosure. Further, FIG. 14 is a perspective view illustrating a state in which a detecting lever is coupled to a driver according to an embodiment of the present disclosure.

Figure 14:
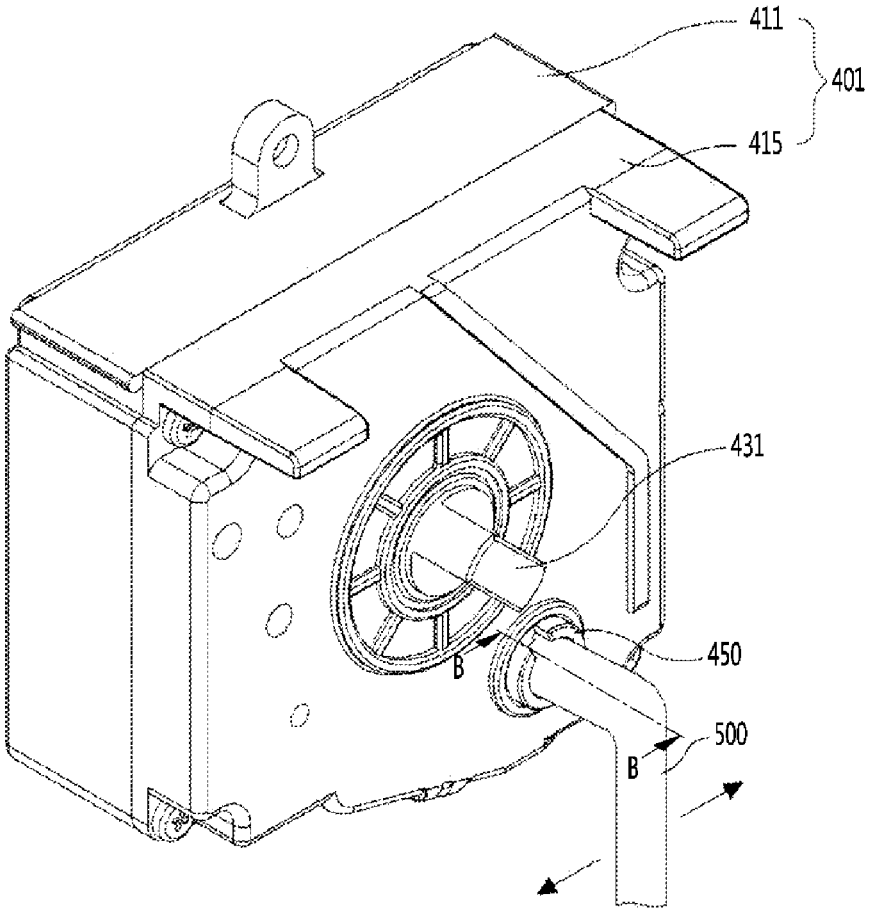
FIG. 14 is a perspective view illustrating a state in which a detecting lever is coupled to a driver according to an embodiment of the present disclosure.
Figure 15:
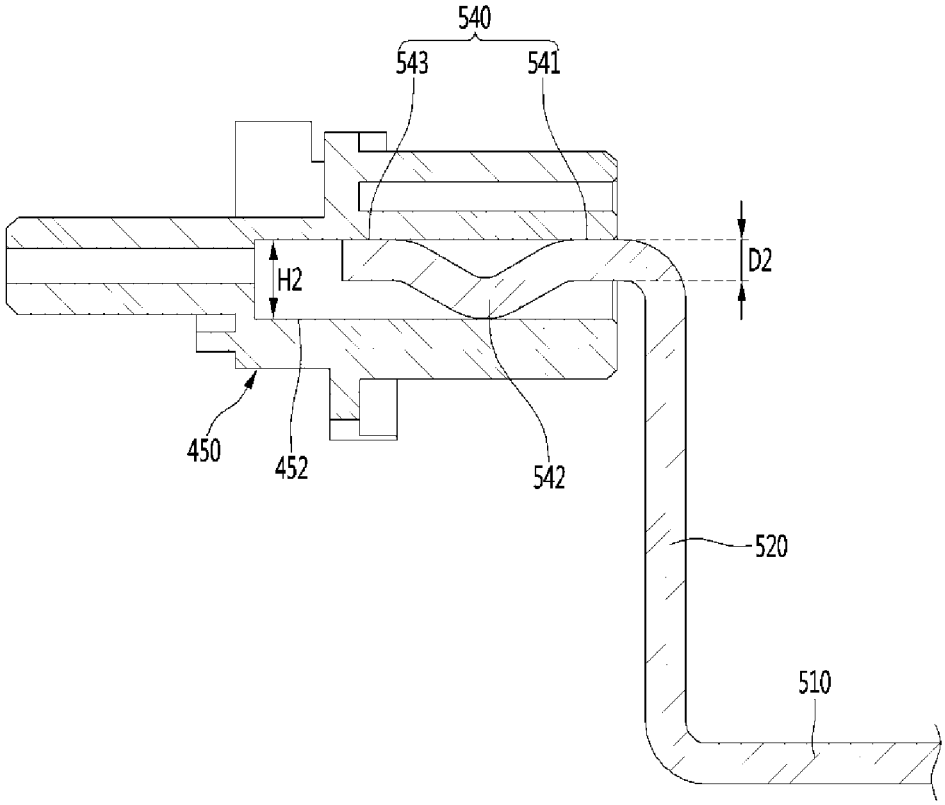
FIG. 15 is a cross-sectional view taken along B-B of FIG. 14.

FIG. 15 is a cross-sectional view taken along B-B of FIG. 14. Further, FIG. 16 illustrates an operating state of a driver according to an embodiment of the present disclosure.

Figure 16:
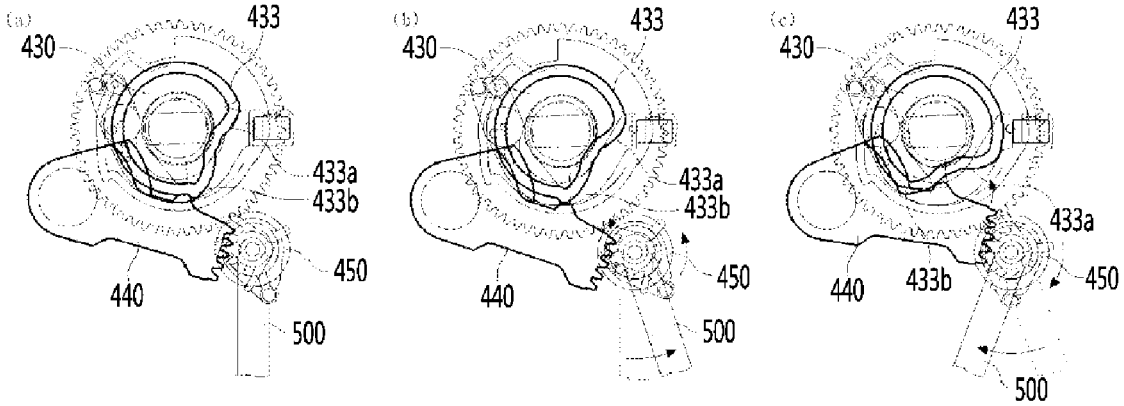
FIG. 16 illustrates an operating state of a driver according to an embodiment of the present disclosure.

In this connection, (a) in FIG. 16 illustrates a state in which an operating lever is positioned on a cam face for a detecting lever of a cam gear. (b) in FIG. 16 illustrates a state in which the operating lever is lowered by a protrusion of the cam gear and the detecting lever is pivoted upward. (c) in FIG. 16 illustrates a state in which the operating lever is inserted into a cam groove for the detecting lever of the cam gear and the detecting lever pivoted downward.

Referring to FIGS. 11 to 16, the driver 400 may include a driving unit 420, a cam gear 430, which rotates the ice maker 210 while rotating by the driving unit 420, and an operating lever 440 organically in association with the cam gear 430 along a cam face for the detecting lever of the cam gear 430.

Further, the driver 400 may further include a lever coupling portion 450 that pivots (swings) the detecting lever 500 in a left and right direction while rotating by the operating lever 440.

The driver 400 may further include a magnetic lever 460 organically in association with the cam gear 430 along a magnetic cam face of the cam gear 430 and a case 410 for mounting the driving unit 420, the cam gear 430, the operating lever 440, the lever coupling portion 450, and the magnetic lever 460 therein.

The case 410 may include a first case 411 for mounting the driving unit 420, the cam gear 430, the operating lever 440, the lever coupling portion 450, and the magnetic lever 460 therein and a second case 415 for covering the first case 411.

The driving unit 420 may include a driving motor 422. The driving motor 422 generates power to rotate the cam gear 430.

The driving unit 420 may further include a control panel 421 coupled to one inner side of the first case 411. The driving motor 422 may be connected to the control panel 421.

A detecting element 423 may be disposed on the control panel 421. The detecting element 423 may include a Hall IC 230 as an example.

The detecting element 423 may output a first signal and a second signal depending on a relative position thereof with the magnetic lever 460.

As shown in FIG. 13, the cam gear 430 may include a coupling portion 431 to which the ice maker 210 is coupled, a gear portion 432 capable of transmitting the power of the driving motor 422, a cam face 433 for the detecting lever, and a magnetic cam face 434.

The cam face 433 for the detecting lever has a cam groove 433*a* for the detecting lever defined therein that lowers (lowers in a direction of the coupling portion 431 viewed from FIG. 13) the operating lever 440 to downwardly pivot the detecting lever 500 into the ice bin 300.

The magnetic cam face 434 has a magnetic cam groove 434*a* defined therein that lowers (lowers in a direction opposite to the coupling portion 431 viewed from FIG. 13) the magnetic lever 460 to separate the magnetic lever 460 and the detecting element 423 from each other.

A reduction gear 470 may be disposed between the cam gear 430 and the driving motor 422 to reduce a rotational force of the driving motor 422 and transmit the reduced rotational force to the cam gear 430.

The reduction gear 470 may include a first reduction gear 471 connected to the driving motor 422 to be capable of transmitting the power, a second reduction gear 472 engaged with the first reduction gear 471, and a third reduction gear 473 for connecting the second reduction gear 472 with the cam gear 430 with each other such that the power may be transmitted between the second reduction gear 472 and the cam gear 430.

One end of the operating lever 440 is coupled to be freely pivotable to a rotation shaft of the third reduction gear 473 and a gear 442 formed at the other end of the operating lever 440 is connected to be capable of transmitting the power to the lever coupling portion 450. That is, the lever coupling portion 450 pivots when the operating lever 440 moves.

As shown in FIG. 14, one end of the lever coupling portion 450 is pivotably connected to the operating lever 440 inside the case 410 and the other end thereof is protruded out of the case 410 and coupled with the detecting lever 500.

That is, the lever coupling portion 450 is disposed to protrude from a front face of the case 410. This allows the detecting lever 500 to be placed on the front face of the case 410. Accordingly, it is not necessary to secure a separate space for the pivoting of the lever coupling portion 450, and a size of the driver 400 may be reduced.

The lever coupling portion 450 may include an insert portion 452 into which a first coupling portion 540 of the detecting lever 500 is inserted.

A height H2 of the internal space of the insert portion 452 may be greater than the second diameter D2 of the first coupling portion 540. A maximum length in the vertical direction of the first coupling portion 540 may be greater than the height H2 of the internal space of the insert portion 452.

Thus, the first coupling portion 540 may be fitted into the insert portion 452. In this process, the first coupling portion 540 may be elastically deformed.

In the present embodiment, the first horizontal extension portion 541, the bent portion 542 and the second horizontal extension portion 543 may be inserted into the insert portion 452.

Thus, as shown in FIG. 15, the first coupling portion 540 may be in contact with at least three portions on inner circumferential face of the insert portion 452.

According to the present embodiment, since the first coupling portion 540 is fitted into the insert portion 542 and is in contact with the at least three portions of the insert portion 452, the first coupling portion 540 may be prevented from being removed from the insert portion 542 or from running idle with respect to the insertion portion 452.

Further, the bent portion 542 is positioned between the first horizontal extension portion 541 and the second horizontal extension portion 543. Further, the first horizontal extension portion 541 and the second horizontal extension portion 543 are located on the same extension line.

Therefore, the elastic deformation of the first coupling portion 540 may be minimized during the rotation of the detecting lever 500, and a change of a position of the pivot center C of the detecting lever 500 may be minimized.

In one example, the magnetic lever 460 may include a center portion rotatable in the case 410, an end organically in association with the cam gear 430 along with the magnetic cam face 434 of the cam gear 430, and a magnetic 461 to be in contact with or separated from the detecting element 423.

That is, when the magnetic 461 and the detecting element 423 remain in contact with each other, the detecting element 423 outputs a first signal. Further, when the magnetic 461 and the detecting element 423 are separated from each other, a second signal is output.

In another example, the magnetic 461 may not become into contact with the detecting element 423. Also, in this case, when the magnetic 461 moves to a position facing the detecting element 423, the detecting element 423 may output the first signal. When the magnetic 461 is out of the position facing the detecting element 423, the detecting element 423 may output the second signal.

On the rotation shaft of the cam gear 430, a blocking member 480 that selectively blocks the cam groove 433*a* for the detecting lever such that the operating lever 440 moving along the cam face 433 for the detecting lever is not inserted into the cam groove 433*a* for the detecting lever when the detecting lever 500 returns may be disposed.

That is, the blocking member 480 may include a coupling portion 481 pivotably coupled to the rotation shaft of the cam gear 430 and an engaging groove 482 defined at one side of the coupling portion 481 and coupled to the protrusion 413 formed on the bottom of the case 410 to limit an angle of rotation of the coupling portion 481.

Further, the blocking member 480 may further include a supporting protrusion 483 disposed outside of the coupling portion 481 and supported by or separated from the operating lever 440 during forward or reverse rotation of the cam gear to limit an operation of the operating lever 440 such that the operating lever 440 is not inserted into the cam groove for the detecting lever.

Further, the driver 400 may further include an elastic member 490 that provides an elastic force such that the lever coupling portion 450 is pivoted in one direction. One end of the elastic member 490 may be connected to the lever coupling portion 450 and the other end thereof may be fixed to the case 410.

The elastic member 490 may provide, to the detecting lever 500, for example, the elastic force to allow the detecting lever 500 to be pivoted from the standby position to the full ice state detection position.

In one example, in case of the driver 400, a lot of frost is formed at the outside of the case 410. When the detecting lever 500 is frozen by this frost, the detecting lever 500 may not pivot smoothly.

To solve this problem, in the present embodiment, the detecting lever 500 may be shaken instantaneously by the cam gear during the downward pivoting of the detecting lever 500. Thus, the freezing of the detecting lever 500 may be easily solved.

Between the cam face 433 and cam groove 433*a* for the detecting lever of the cam gear 430, a protrusion 433*b* may be disposed to allow the detecting lever 500 to vibrate in the vertical direction as instantaneously upwardly pivoting the detecting lever 500, which is downwardly pivoted into the ice bin 300.

That is, as shown in FIG. 16, the protrusion 433*b* may be formed to protrude in a semicircular shape in an outward direction between the cam face 433 for the detecting lever and the cam groove 433*a*.

As the operating lever 440 moves over such semicircular protrusion 433*b*, the operating lever 440 instantly ascends and then descends.

As the operating lever 440 ascends and descends, the lever coupling portion 450 instantaneously pivots upwards and then downwards. Further, the freezing of the detecting lever 500 may be solved by an operating force occurring while the detecting lever 500 in association with the lever coupling portion 450 is instantaneously shaken in the vertical direction.

That is, an effect of shaking the detecting lever 500 in the vertical direction may be obtained by the protrusion 433*b*. The freezing of the detecting lever 500 may be easily solved by such shaking effect.

Figure 17:
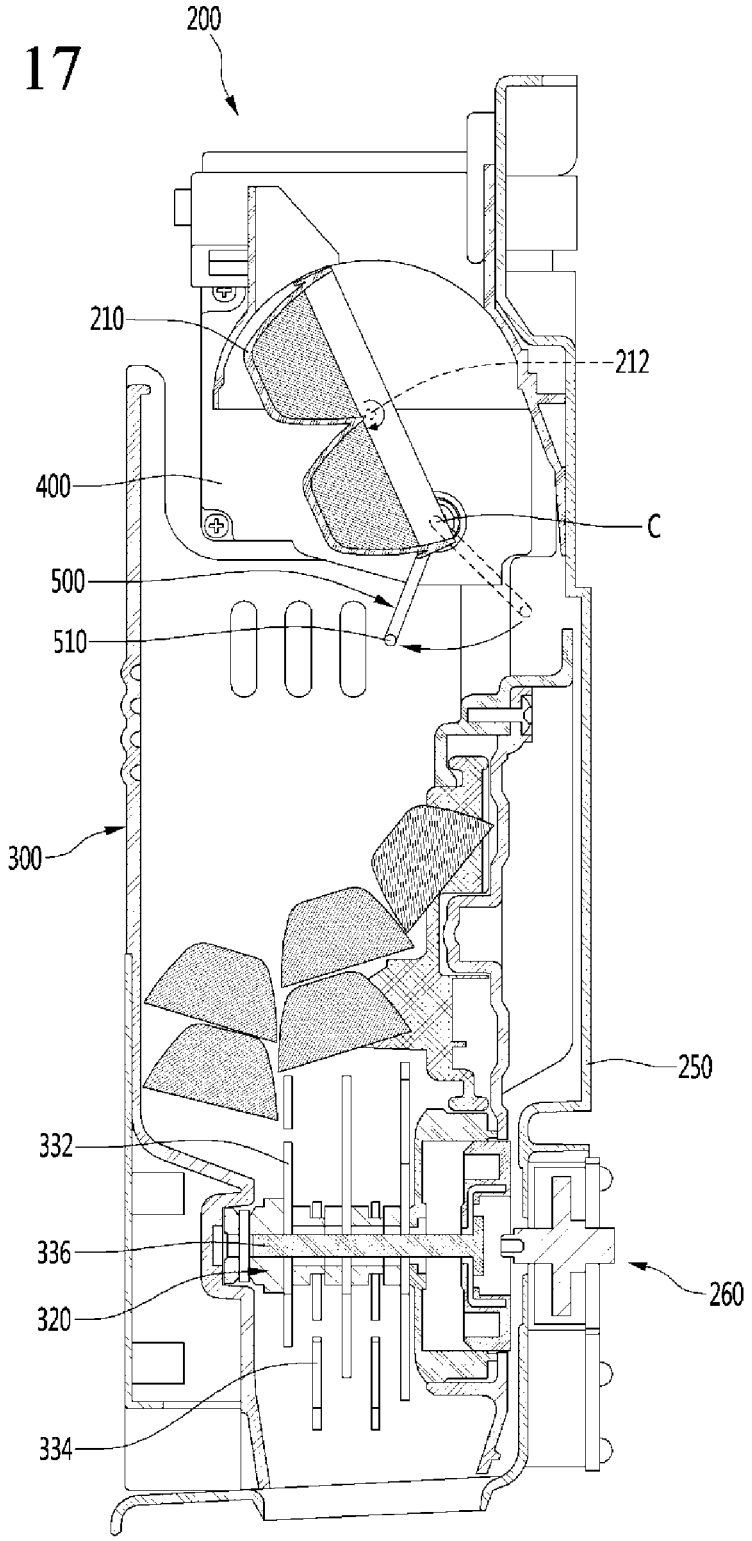
FIG. 17 illustrates a state in which a detection lever of the present disclosure is moved to a full ice state detection position.
Figure 18:
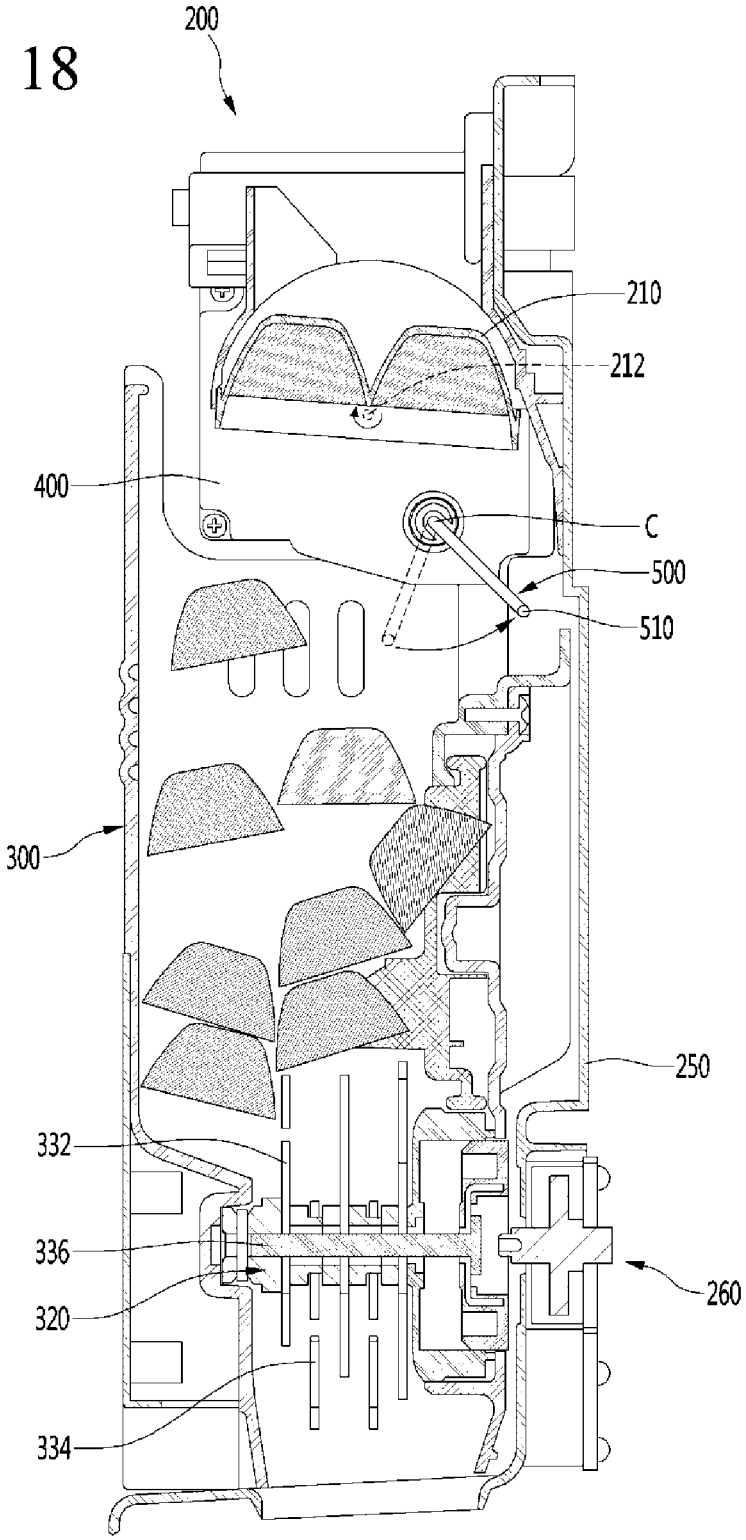
FIG. 18 illustrates ice being separated from an ice maker.
Figure 19:
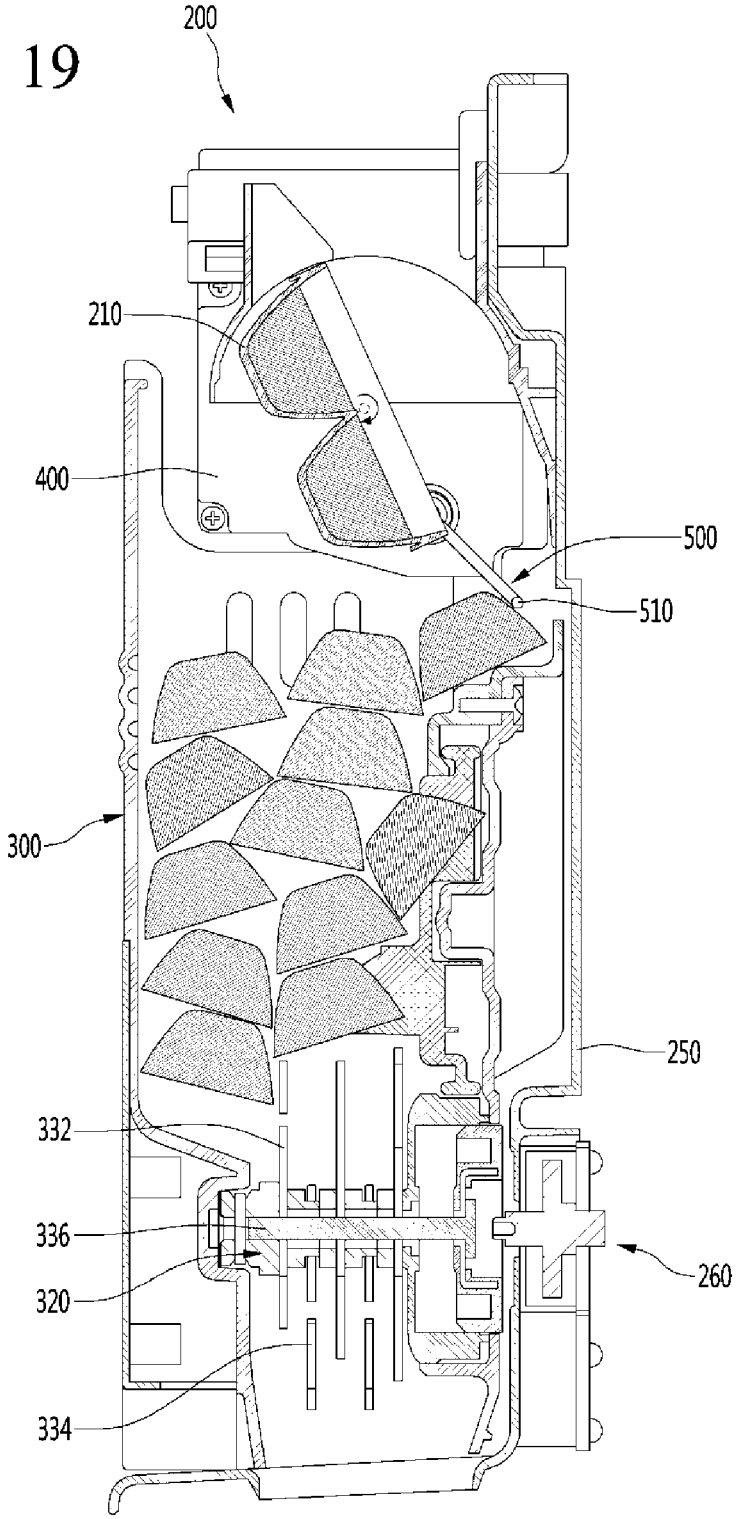
FIG. 19 illustrates a detecting lever rotating in a full ice state of an ice bin.

FIG. 17 illustrates a state in which a detection lever of the present disclosure is moved to a full ice state detection position. Further, FIG. 18 illustrates ice being separated from an ice maker. Further, FIG. 19 illustrates a detecting lever rotating in a full ice state of an ice bin.

Referring to FIGS. 1 to 18, in order to separate the ice from the ice maker 210 after the ice is generated from the ice maker 210, the ice maker 210 may be rotated in a first direction (a clockwise direction based on FIG. 17) by the power of the driving motor 422.

In this connection, an entirety of the ice maker 210 may be rotated and twisted, and the ice may be separated from the ice maker 210 by such twisting.

In other words, when the ice maker 210 is twisted, one end and the other end of the ice maker 210 are relatively moved to occur a torsion. Thus, the ice is separated from the ice maker 210. A twisting principle of the ice maker 210 is the same as the known content, so that a detailed description thereof will be omitted.

The ice separated from the ice maker 210 is dropped to the ice bin 300 through the ice inlet 310 of the ice bin 300.

When the ice maker 210 is rotated, the detecting lever 500 is driven by the driving motor 422 to be rotated from the standby position in FIG. 8 to the full ice state detection position in FIG. 17.

In the present embodiment, a position of the ice maker 210 when the detecting lever 500 moves to the full ice state detection position may be referred to as an intermediate position.

In this connection, as shown in FIG. 17, when the ice bin 300 is not full of the ice, the detecting lever 500 may be pivoted to the full ice state detection position without interfering with the ice in the ice bin 300.

In the state in which the detecting lever 500 is located at the standby position, the second signal may be output from the detecting element 423 as an example.

When the detecting lever 500 is pivoted to the full ice state detection position, the first signal may be output from the detecting element 423.

In this connection, the detecting lever 500 may be rotated from the standby position to the full ice state detection position only when the ice maker 210 is rotated by a predetermined angle.

When a portion of the operating lever 440 is aligned with the cam groove 433*a* for the detecting lever after being in contact with the cam face 433 for the detecting lever, a portion of the operating lever 440 is received in the cam groove 433*a* for the detecting lever by the elastic force of the elastic member 490. The operating lever 440 may be pivoted while a portion of the operating lever 440 is accommodated in the cam groove 433*a* for the detecting lever. When the operating lever 440 is rotated, a pivoting force of the operating lever 440 is transmitted to the lever coupling portion 450, so that the detecting lever 500 may be pivoted in the opposite direction to the operating lever 440.

Therefore, when the first signal is output for a predetermined time, it may be determined that the ice bin 300 is not in the full ice state. When the ice bin 300 is not in the full ice state, the ice maker 210 may be rotated further from the intermediate position in the first direction as shown in FIG. 18 to the ice separation position.

Then, the ice may be separated from the ice maker 210 and the ice separated from the ice maker 210 may be dropped into the ice bin 300.

When a portion of the operating lever 440 is out of the cam groove 433*a* for the detecting lever and then comes into contact with the cam face 433 for the detecting lever again in a process in which the ice maker 210 is further rotated in the first direction, the operating lever 440 may be rotated from the full ice state detection position to the standby position.

The detecting body 510 may overlap in the vertical direction with the ice maker 210 in a state in which the detecting lever 500 is rotated to the full ice detection position.

Referring to FIG. 18, the ice maker 210 as described above may be further rotated in the first direction from the intermediate position to the ice separation position.

In this connection, the detecting lever 500 may return to the standby position before the ice maker 210 is rotated to the ice separation position.

Thus, the ice separated from the ice maker 210 may be smoothly dropped to the ice bin 300 without interfering with the detecting lever 500.

In one example, as shown in FIG. 19, in the full ice state of the ice bin 300, when the ice maker 210 is rotated in the first direction to separate the ice from the ice maker 210, the detecting body 510 of the detecting lever 500 comes into contact with the ice stored in the ice bin 300.

In this case, even when the ice maker 210 moves to the intermediate position, the detecting lever 500 interferes with the ice, so that the detecting lever 500 may not be able to move from the standby position to the full ice state detection position. Then, the second signal is continuously output from the detecting element 423.

As such, when the first signal is not output for a predetermined time from the detecting element 423 while the ice maker 210 is moved to the intermediate position, the ice bin 300 is determined to be in the full ice state.

When the ice bin 300 is determined to be in the full ice state, the ice maker 210 may be rotated in the second direction opposite to the first direction to return to the ice-making position, without being rotated further in the first direction from the intermediate position.

The present embodiment provides a refrigerator and an ice-making assembly for preventing jam of ice in a process of operating a detecting lever for detecting a full ice state.

The present embodiment provides a refrigerator and an ice-making assembly in which an additional space for rotating a detecting lever for detecting a full ice state on a side of the ice maker is unnecessary.

The present embodiment provides a refrigerator and an ice-making assembly that may detect a full ice state while reducing a thickness of the refrigerator door.

The present embodiment provides a refrigerator and an ice-making assembly that may rotate a detecting lever even when ice is generated at a portion to which the detecting lever is connected.

In one aspect, there is provided an ice-making assembly including an ice maker for making ice, an ice bin located below the ice maker, wherein the ice bin stores ice separated from the ice maker therein, and a detecting lever located below the ice maker and including a pivotable detecting body, wherein the detecting lever detects a full ice state of the ice bin.

In one implementation, the detecting lever may be formed as a wire is bent several times.

In one implementation, the ice maker may be rotatably coupled to a support bracket. Further, the detecting lever may be pivotably connected to the support bracket.

In one implementation, the detecting lever may be pivotable by a power of the driver.

In one implementation, a direction of extension of a pivot center of the detecting lever may be parallel to a direction of extension of a center of rotation of the ice maker.

In one implementation, a pivot center of the detecting lever may be located lower than a center of rotation of the ice maker.

In one implementation, the detecting lever may further include a first extension portion and a second extension portion respectively extending from both ends of the detecting body in a direction intersecting a direction of extension of the detecting body.

In one implementation, a length of the detecting body may be larger than a length of each of the extension portions.

In one implementation, the detecting lever may further include a first coupling portion and a second coupling portion respectively bent from ends of the first and second extension portions and extended in a direction away from each other.

In one implementation, the first coupling portion may be connected to the driver and the second coupling portion may be connected to the support bracket.

In one implementation, the driver may include a lever coupling portion having an insert portion defined therein for inserting the first coupling portion therein. A maximum length in a vertical direction of the first coupling portion may be greater than a height of an internal space of the insert portion.

In one implementation, the first coupling portion may include a first horizontal extension portion extending in a horizontal direction from the first extension portion. The first horizontal extension portion may be parallel with the detecting body.

In one implementation, the first coupling portion may further include a bent portion bent from the first horizontal extension portion. Further, in one implementation, the first coupling portion may further include a second horizontal extension portion extending in the horizontal direction from an end of the bent portion.

In one implementation, the bent portion may include a first inclined portion inclined downward from the first horizontal extension portion and a second inclined portion inclined upward from the first inclined portion. A boundary portion of the first inclined portion and the second inclined portion may be located at the lowermost side in the first coupling portion.

In one implementation, the second coupling portion may include a coupling body extending in the horizontal direction from the second extension portion and a hooking body bent from the coupling body. A hole through which the second coupling portion passes may be defined in the support bracket.

In one implementation, a cross section of the coupling body may be circular and a diameter of the coupling body may be smaller than a width and a height of the hole.

In one implementation, a vertical length of the second coupling portion may be smaller than the width of the hole.

In another aspect, there is provided a refrigerator including an ice compartment for receiving cool air, an ice maker located in the ice compartment, an ice bin located in the ice compartment, wherein the ice bin stores ice separated from the ice maker therein, and a detecting lever located below the ice maker including a pivotable detecting body, wherein the detecting lever detects a full ice state of the ice bin.

In one implementation, the refrigerator may further include a driver for rotating the ice maker and a support bracket for rotatably supporting the ice maker.

In one implementation, one side of the detecting lever may be connected to the driver and the other side of the detecting lever may be pivotably connected to the support bracket.

In one implementation, the detecting lever may be formed as a wire is bent several times.

In one implementation, the detecting body may extend in a direction parallel to a direction of extension of a center of rotation of the ice maker.

In one implementation, the detecting lever may further include first and second extension portions respectively bent and extended from both ends of the detecting body and a first coupling portion and a second coupling portion extending in a direction away from each other respectively from ends of the first and second extension portions.

In one implementation, the first coupling portion may be inserted into the driver. Further, the second coupling portion may become to be in an idle state in a state of being passed through the support bracket.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice-making assembly comprising:

an ice maker configured to produce ice, and the ice maker configured to provide the ice;

an ice bin disposed at least partially below the ice maker, the ice bin configured to receive the ice from the ice maker;

a driver configured to rotate the ice maker such that the ice is to separate from the ice maker based on the rotation; and a detecting lever disposed at least partially below the ice maker, the detecting lever including a pivotable detecting body, wherein the detecting lever is configured to detect an ice state of the ice bin, wherein the detecting body extends in a first direction from a first end to a second end, the detecting lever includes a first extension and a second extension, the first extension extending from the first end of the detecting body in a second direction that traverses the first direction, and the second extension extending from the second end of the detecting body in the second direction, wherein the detecting lever includes a first coupling portion and a second coupling portion, the first coupling portion to extend in a third direction from an end of the first extension, and the second coupling portion to extend in a fourth direction from an end of the second extension, the fourth direction being opposite from the third direction, wherein the driver is configured such that when the driver is operated, the ice maker is to rotate and the detecting lever is to pivot, wherein while the ice maker is rotated in a first rotate direction to a first angle, the detecting lever is to pivot in the first rotate direction to a full ice state detection position, and wherein when the ice bin is determined to not be in the full ice state when the detecting lever pivots to the full ice state detection position, while the ice maker is rotated in the first rotate direction to a second angle greater than the first angle, the detecting lever is to pivot in a second rotate direction.

2. The ice-making assembly of claim 1, comprising a support bracket to rotatably support the ice maker, wherein the detecting lever is pivotably connected to the support bracket.

3. The ice-making assembly of claim 2, wherein the first coupling portion is coupled to the driver, and the second coupling portion is coupled to the support bracket.

4. The ice-making assembly of claim 3, wherein the driver includes a lever coupler having an insertion portion for receiving the first coupling portion, and wherein the first coupling portion and the second coupling portion are located at the same vertical level.

5. The ice-making assembly of claim 2, wherein the first coupling portion includes:

a first horizontal extension extending in the third direction from the end of the first extension;

a bent portion coupled to the first horizontal extension; and a second horizontal extension coupled to the bent portion and extending in the third direction from the bent portion, wherein the bent portion is bent from the first horizontal extension, and the bent portion is bent from the second horizontal extension.

6. The ice-making assembly of claim 5, wherein the bent portion includes a first inclined portion that is inclined downward from the first horizontal extension and a second inclined portion that is inclined upward from the first inclined portion, and wherein a boundary of the first inclined portion and the second inclined portion is at a lowermost side of the first coupling portion.

7. The ice-making assembly of claim 2, wherein the second coupling portion includes a coupling body extending in the fourth direction from the end of the second extension and a hooking body that is bent from the coupling body, and wherein the support bracket includes a hole through which the second coupling portion is to pass.

8. The ice-making assembly of claim 7, wherein a cross section of the coupling body is circular, and a diameter of the coupling body is less than a width of the hole and a height of the hole.

9. The ice-making assembly of claim 8, wherein a vertical length of the second coupling portion is less than the width of the hole.

10. The ice-making assembly of claim 1, wherein a direction of extension of a pivot center of the detecting lever is parallel to a rotational shaft of the ice maker.

11. The ice-making assembly of claim 1, wherein the detecting lever has a pivot center that is disposed lower than a rotational shaft of the ice maker.

12. The ice-making assembly of claim 1, wherein a length of the detecting body from the first end to the second end is greater than a length of the first extension, and the length of the detecting body from the first end to the second end is greater than a length of the second extension.

13. A refrigerator comprising:

a compartment to receive cool air;

an ice maker at the compartment, the ice maker configured to provide ice;

a driver configured to rotate the ice maker such that the ice is to separate from the ice maker based on the rotation;

an ice bin at the compartment, wherein the ice bin is configured to receive ice separated from the ice maker; and a detecting lever disposed at least partially below the ice maker, the detecting lever including a pivotable detecting body, wherein the detecting lever is configured to detect a state of the ice bin, wherein the detecting body extends in a first direction from a first end to a second end, the detecting lever includes a first extension and a second extension, the first extension extending from the first end of the detecting body in a second direction that traverses the first direction, and the second extension extending from the second end of the detecting body in the second direction, wherein the detecting lever includes a first coupling portion and a second coupling portion, the first coupling portion to extend in a third direction from an end of the first extension, and the second coupling portion to extend in a fourth direction from an end of the second extension, wherein the first coupling portion and the second coupling portion are disposed lower than a lower end of the ice maker, wherein the driver is configured such that when the driver is operated, the ice maker is to rotate and the detecting lever is to pivot, wherein while the ice maker is rotated in a first rotate direction to a first angle, the detecting lever is to pivot in the first rotate direction to a full ice state detection position, and wherein when the ice bin is determined to not be in the full ice state when the detecting lever pivots to the full ice state detection position, while the ice maker is rotated in the first rotate direction to a second angle greater than the first angle, the detecting lever is to pivot in a second rotate direction.

14. The refrigerator of claim 13, further comprising:

a support bracket to rotatably support the ice maker, wherein the first coupling portion of the detecting lever is coupled to the driver and the second coupling portion of the detecting lever is pivotably coupled to the support bracket.

15. The refrigerator of claim 14, wherein the first coupling portion is inserted into the driver, and wherein the second coupling portion is coupled through the support bracket in an idle state.

16. The refrigerator of claim 13, wherein the fourth direction is opposite from the third direction.

17. A refrigerator comprising:

a compartment to receive cool air;

an ice maker at the compartment, the ice maker configured to provide ice;

a driver configured to rotate the ice maker such that the ice is to separate from the ice maker based on the rotation;

an ice bin at the compartment, wherein the ice bin is configured to receive ice separated from the ice maker; and a detecting lever disposed at least partially below the ice maker, the detecting lever including a pivotable detecting body, wherein the detecting lever is configured to detect a state of the ice bin, wherein the driver is configured such that when the driver is operated, the ice maker is to rotate and the detecting lever is to pivot, wherein while the ice maker is rotated in a first direction to a first angle, the detecting lever is to pivot in the first direction to a full ice state detection position, and wherein when the ice bin is determined to not be in the full ice state when the detecting lever pivots to the full ice state detection position, while the ice maker is rotated in the first direction to a second angle greater than the first angle, the detecting lever is to pivot in a second direction.

* * * * *